United States Patent [19]

Furmanski et al.

[11] Patent Number: 4,485,718

[45] Date of Patent: Dec. 4, 1984

[54] RAPID DE-ICING SYSTEM

[75] Inventors: Walery Furmanski; Herman Schmid, both of Karlskoga, Sweden

[73] Assignee: Aktiebolaget Bofors, Bofors, Sweden

[21] Appl. No.: 435,513

[22] Filed: Oct. 20, 1982

[30] Foreign Application Priority Data

Oct. 22, 1981 [SE] Sweden ..... 81062341

[51] Int. Cl.[3] ..... F42B 1/00; F42D 3/00

[52] U.S. Cl. ..... 89/1.14; 89/1.817; 102/301; 244/134 R

[58] Field of Search ..... 89/1 B, 1.817; 244/134 R, 121, 122 AF; 102/301, 314, 325

[56] References Cited

U.S. PATENT DOCUMENTS

| | | | |
|---|---|---|---|
| 2,930,554 | 3/1960 | Johnson | 244/134 R |
| 3,135,163 | 6/1964 | Mechlin et al. | 89/1.817 X |
| 3,335,664 | 8/1967 | Enzian | 89/1 B X |
| 3,486,410 | 12/1969 | Drexelius et al. | 89/1 B |
| 3,742,814 | 7/1973 | Kroh | 89/1.817 X |
| 3,789,759 | 2/1974 | Jones | 89/1 B |
| 3,800,703 | 4/1974 | Murakami | 89/1.817 X |
| 4,275,858 | 6/1981 | Bolton et al. | 89/1 B X |
| 4,301,707 | 11/1981 | Schimmel et al. | 89/1 B |
| 4,301,708 | 11/1981 | Mussey | 89/1.817 |

FOREIGN PATENT DOCUMENTS 897878 5/1962 United Kingdom ..... 89/1.817

*Primary Examiner*—David H. Brown

*Attorney, Agent, or Firm*—Pollock, Vande Sande & Priddy

[57] ABSTRACT

A method and a device for the purpose of de-icing those covers and other surfaces of limited size which can be subjected to severe icing and which it may be necessary to make ice-free at very short notice. Examples of the types of surfaces intended are protective doors for shipborne missiles and torpedo tubes, emergency exit doors, and helicopter landing platforms etc. These surfaces are de-iced by an interior igniting primed tubular power charge which in the case of doors is placed directly in a groove along edges which the door seals against the surrounding door frame or another mating door, and in the case of other types of surfaces is placed in accordance with a pattern intended for that particular surface. The tubular powder charge is placed in an open groove in the relevant surface which faces in the same direction as it is desired that the ice should be flaked loose.

15 Claims, 3 Drawing Figures

RAPID DE-ICING SYSTEM

TECHNICAL FIELD

This invention relates to a method and a device for the purpose of rapidly de-icing those doors or other surfaces which are subjected to severe icing and which it may be necessary to de-ice at very short notice. The invention relates primarily to a method of de-icing protective doors for ship-borne missile launchers and torpedo tubes but it can also be used on various types of emergency exit doors or other surfaces which are subjected to the same type of problem.

BACKGROUND OF THE INVENTION

In cold climates the forming of ice on ships and ship-borne equipment has always been a problem. Under certain weather conditions even land based material can be subjected to severe icing. Apart from the purely safety aspects, icing has always caused spcial difficulties with regard to keeping missiles and torpedoes ready for firing in all types of weather. These types of weapons are dependent on large launching openings which when they are to be fired must be completely free from ice.

In the case of large vessels having access to electric blower and perhaps even high pressure steam it is no great problem to arrange more or less continual de-icing for the most important weaponry. This is not the case on small vessels where the problem is very much greater e.g., missile and torpedo boats, which quite simply do not have access to sufficient energy or, for reasons of space, supplies of energy can not be made accessible in sufficient quantities for conventional de-icing of the doors on missile launchers or torpedo tubes. A possible solution is of course to open the relevant doors with such force that any ice is torn away but this method requires doors and door opening mechanisms specially designed for this purpose. This in turn means that these components would have to be made very much stronger than otherwise would be necessary and this is often quite unthinkable, as the whole weapon system would then be far too heavy and clumsy. For certain types of ship-borne missile launchers it has therefore been chosen to blast away the front doors or cowlings of these weapons but this solution should only be applicable to smaller types of launchers as larger doors which have been blasted away would be a danger even to the mother ship.

Other solutions for blasting away ice using a conventional charge have not been shown to be a satisfactory alternative as doors and door frames must be made so strong that they will not be deformed while at the same time the risk is run that the ships crew and material will be damaged by flying pieces of ice. To remove the ice by chemical means is of course theoretically possible but it requires too much time and it is also a technically complicated procedure.

DISCLOSURE OF THE INVENTION

In this context this invention relates to a method and a device for rapidly removing ice from principally ship-borne doors which are capable of being swung from a closed to an open position, or alternatively disposable, and which are subject to the risk of icing and which it may be necessary to activate at very short notice. This invention can therefore be relevant principally in the case of various types of weapons, primarily missile launchers and torpedo tubes and various types of emergency equipment.

It should even be possible to use the invention for de-icing larger surfaces which are subjected to the same icing problem and which it may also be necessary to de-ice at very short notice. Examples of such surfaces are ship-borne helicopter landing platforms.

According to the invention interior igniting tubular powder charges are placed in open grooves in the relevent surface. These grooves are open forward in the direction it is intended that the ice should be flaked loose. If the said surface consists of a cover, the tubular powder charges are best placed in the immediate vicinity of the outer edges of the cover. In the case of larger surfaces, the tubular powder charges should be placed in a pattern specially adapted to that particular surface. Also in the case of larger surfaces the method of de-icing according to the invention should function best if the surface can be made by the pressure generated by the tubular powder charge. The method can therefore be expected to function well on e.g., ships decks of steel.

Interior ignition of the tubular powder charge is by means of a conventional electronic igniter or equivalent, possibly fitted with a booster charge. It is essential that the hot gases from the igniter are actually led in to the tubular powder charge in such a way that it is immediately ignited internally along its entire length. To allow this to occur the tubular powder charge must not be led round too sharp corners. The powder then burns from the inside and outwards at a rate proportional to the back pressure which in this case means that the charge will be self-regulating with regard to explosive effect and the thickness of ice which is to be removed as it is the thickness of ice which is responsible for the back pressure. The thicker the layer of ice the greater will be the rate of burning of the powder and the more powerful the blast effect achieved. With charges according to the invention the powder burns at an increasing rate until a sufficiently high internal pressure have been generated to flake away all the ice covering the tubular powder charge and the surroundings in one powerful wave of pressure, this being the same as completely de-icing the relevant door opening. When the relevant door or surface is made of metal the generated oscillations in the surface will complement the pressure wave directly generated by the charge and vibrate the ice into pieces thereby freeing the entire surface from ice.

With a back pressure of zero, i.e., with ice-free surfaces the rate of burning of tubular powder charge will be so low as to have no explosive effect at all as only parts of the tubular powder charge will have burned when the tubular powder charge is split up and burned.

In this context it is completely safe to be in the vicinity of a de-icing charge according to the invention when it is ignited in the absence of ice on the relevant surface or cover, and even when ice of great thickness has formed the ice particles are seldom thrown further that a few meters. There is therefore a considerable difference between those risks connected with being it the vicinity of a de-icing charge of the type according to the invention i.e., loaded with slow burning powder, and previously de-icing charges loaded with detonating explosive materials.

To ensure a suitable building up of pressure and protection of the tubular powder charge from moisture and damage they should be moulded in a suitable water and shock-proof, preferably elastic polymer material such as moisture resistant silicon rubber and placed in the grooves intended to receive them. It has even been found that in certain cases it is most suitable if the tubular powder charge to be used is armoured with an outer case of plaited nylon fibre, meshed polyethylene foil, or similar.

There is also a special ignition method for the interior ignition of the charges according to the invention. The said method is based on the hot gases from a conventional igniter being led a part of the way in to the tubular powder charges by means of a metal tube i.e., the tubular powder charge is at its outer end entered over the metal tube. With this type of ignition the metal tube can be formed at an angle or given a "T" shape thereby allowing the igniter to be placed on the inside of a door. In this way the igniter will be more accessible and well protected.

BRIEF DESCRIPTION OF THE DRAWINGS

The invention is defined in the patent claims and will now be described in more detail with the aide of the enclosed sketches in which:

DESCRIPTION OF BEST MODE AND OTHER EMBODIMENTS

Figure 1:
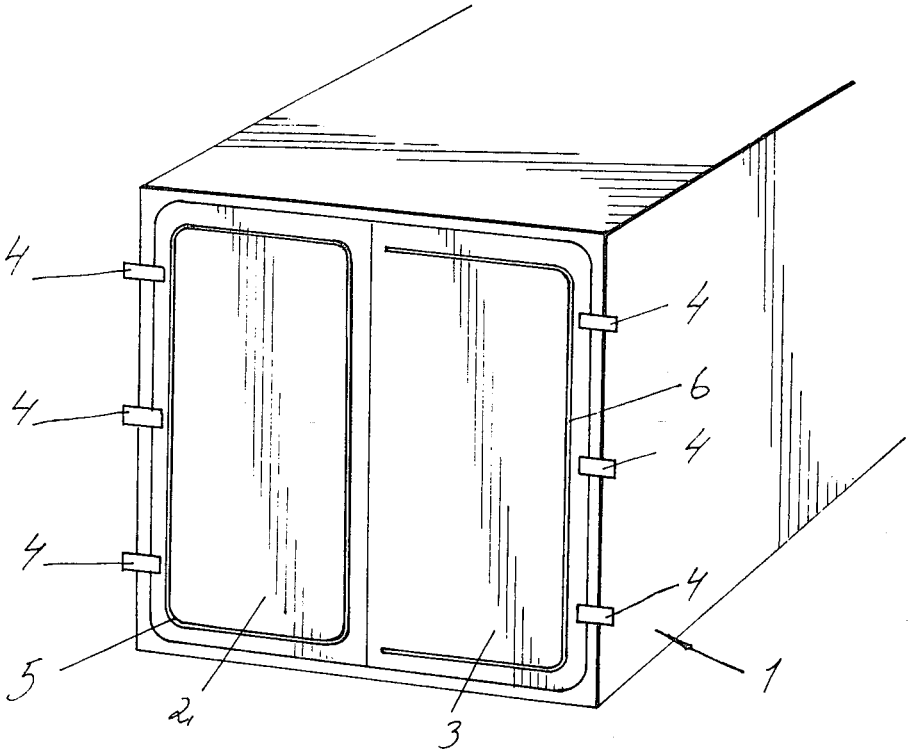
FIG. 1 shows a front or rear door of a missile launcher for e.g., sea missiles.

The missile launcher (1) shown in FIG. 1 is fitted with two cofunctioning double doors (2) and (3). The said doors can be swung and are hung on hinges (4). The doors open outwards and in the shown example are folded in towards the front opening of the missile launcher. Sealing strips (not shown) are fitted between the doors and the inner edges of the missile launcher. The door (2) overlaps and seals against the door (3) along their common edge. As the missile launcher acts as the missiles protective packaging in which it can be stored without problem for many years the fit between doors and launcher edges and between the doors themselves is very good.

The mechanism which opens the doors immediately prior to launching the missile is located protectively inside the missile launcher, and as it is not included in the invention it will be dealt with no further here.

Close to the outer edges of the doors (2) and (3) grooves (5) and (6) are milled. A cross-section through a similar groove is shown in FIG. 2.

Note that only the door (2) is equipped with a groove facing the other door. Surprisingly, it has been ascertained that two de-icing charges located close to each other to a certain extent counteract the effect of each other. This would appear to be due to those oscillations which are generated in the doors when the charge is ignited.

Figure 2:
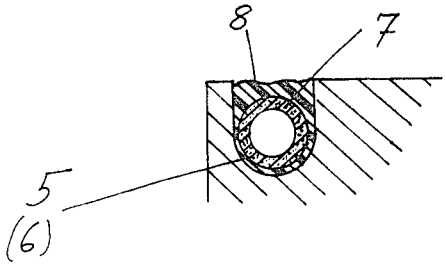
FIG. 2 shows on a larger scale a cross-section through a door edge with the tubular powder charge in position.

As can be seen in FIG. 2 the grooves (5) and (6) are somewhat deeper than the height of the tubular powder charge (7) located therein. The tubular powder charge is moulded into the groove in moisture resistant silicon rubber (8). In addition the groove is located as close to the edge of the door as possible without risk of deformation to the actual door.

As far as the composition of the tubular powder charge is concerned it is preferable that a single-hole, double-base powder having the following composition be used:

| | |
|---|---|
| Cellulose trinitrate | 48% |
| Glycerol trinitrate | 38% |
| Combustion catalyst | 7% |
| Softener | 7% |

On a divided aluminium missile launcher door dimensioned to 1×1 m approximately and intended to be opened by springs, a single hole tubular powder charge of the above composition has an outer diameter of 6 mm approximately and an inner diameter of 4 mm approximately.

It can be said in general that tubular powder charges of the type described here should have a ratio between the inner and outer diameters of between 1:1.15 and 1:7.0 and the powder should have a rate of burning of 100 mm/S at a pressure of 100 MPA.

Multi-hole powder charges may of course be used for the same purpose.

Figure 3:
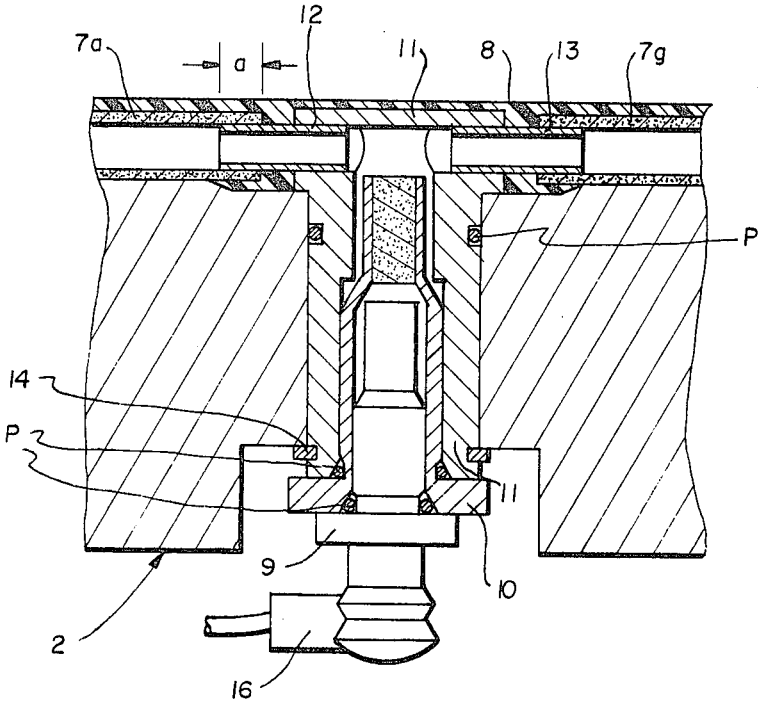
FIG. 3 shows a cross-section through a primed igniter and parts of the tubular powder charge connected to it.

The electrically operated igniter (9) shown in FIG. 3 is in this context located on the inside of the door or cover (2). The igniter (9) is screwed into the booster charge (10) which in turn is screwed into a T-junction (11) mounted on the door.

The igniter (9) is connected via the booster charge (10) to the leg of the T-junction (11) while the insert tubes (12) and (13) are connected to the arms of the T-junction. The T-junction is completely empty. Each of the insert tubes (12) and (13) enter into its own tubular powder charge (7) and (*7a*) for a short distance. The tubular powder charges (7) and (*7a*) are moulded in silicon rubber (8). Due to the insert tubes (12) and (13) being entered a short distance into its own tubular powder charge, internal ignition of the tubular powder charges is ensured. If it is wished to ignite only one of the tubular powder charges, one of the arms of the T-junction (11) should be blocked. FIG. 3 also shows the packings (p), the locking ring (14), and the electric cable (16) for ignition of the igniter.

What is claimed is:

1. An apparatus for rapidly de-icing a surface comprising:

an elongated groove in said surface open in the direction of ice to be removed from said surface;

a tubular charge of powder positioned in said groove with the axis of said tubular charge parallel to the axis of said groove; and, means for igniting said tubular powder charge internally along its length;

said tubular powder charge upon ignition burning from the inside outwards at a rate proportional to the thickness of a layer of ice over said open groove, and said burning rate being sufficiently high to flake said layer of ice loose from said surface and sufficiently low in the absence of said layer of ice that the burning of said charge has no explosive effect.

2. The apparatus of claim 1 for rapidly de-icing the outer surfaces of a plurality of doors with adjacent edges, and in which only tubular powder charge is located in the immediate vicinity of said adjacent edges.

3. The apparatus of claim 1 in which said tubular powder charge has a single hole and in which the powder of said charge comprises a double-base powder having a burning rate of approximately 100 mm/s at a pressure of about 100 MPA.

4. The apparatus of claim 1 in which said tubular powder charge has a wall defining an internal passageway extending internally along its length, and in which said ignition means comprises means for providing hot gases within said passageway so as to internally ignite said tubular powder charge immediately along the entire length of said passageway.

5. The apparatus of claim 4 in which said tube wall is cylindrical and the ratio between the inner and outer diameters of said tube wall is between 1:1.15 and 1:7.0.

6. The apparatus of claim 1 in which said surface comprises an outer surface of a door having a sealing edge movable outward in a door opening direction, and in which the opening of said groove faces in said door opening direction.

7. The apparatus of claim 6 in which the opening of said groove is located in the immediate vicinity of said sealing edge.

8. The apparatus of claim 7 in which said door is a first door and at least a portion of the sealing edge of said first door is adjacent to a sealing edge of a second door, and in which there is no tubular powder charge in the immediate vicinity of said sealing edge of said second door, the burning rate of said tubular powder charge in the immediate vicinity of said sealing edge of said first door being sufficient to cause the flaking loose of a layer of ice from said adjacent sealing edge of said second door.

9. The apparatus of claim 1 in which a moisture resistant material is located between said tubular powder charge and said groove opening.

10. An apparatus according to claim 9 in which said tubular powder charge is molded within a moisture resistant material.

11. The apparatus according to claim 10 in which said moisture resistant material is an elastic polymer material such as silicone rubber.

12. The apparatus of claim 1 in which said tubular powder charge has an internal longitudinally extending passageway, and said ignition means comprises an igniter for providing flame and/or hot gases for igniting said charge and having a tube inserted a short distance into said passageway so as to lead said flame and/or hot gases into said passageway.

13. The apparatus of claim 12 in which said igniter is equipped with a booster charge.

14. The apparatus of claim 12 in which said igniter is placed at an angle to the longitudinal axis of said tubular powder charge and includes an angled tube means for leading said flame and/or hot gases into said passageway.

15. The apparatus of claim 14 which includes two of said tubular powder charges one extending longitudinally in a direction different from the other, and in which said angled tube means comprises a T-junction having two tube sections one inserted a short distance into the passageway of said one charge and the other inserted a short distance into the passageway of said other charge so as to lead said flame and/or hot gases into said passageways.

* * * * *